US011945678B1

(12) United States Patent
Jordan et al.

(10) Patent No.: US 11,945,678 B1
(45) Date of Patent: Apr. 2, 2024

(54) STRUT FOR A SPOOL-HOLDING RACK AND A SPOOL-SUPPORTING AXLE ASSEMBLY FOR USE THEREWITH

(71) Applicants: David S. Jordan, Knoxville, TN (US); Michael C. Jordan, Knoxville, TN (US); Scott M. Jordan, Knoxville, TN (US)

(72) Inventors: David S. Jordan, Knoxville, TN (US); Michael C. Jordan, Knoxville, TN (US); Scott M. Jordan, Knoxville, TN (US)

(73) Assignee: iTool Equipment Holding LLC, Clinton, TN (US)

( * ) Notice: Subject to any disclaimer, the term of this patent is extended or adjusted under 35 U.S.C. 154(b) by 228 days.

(21) Appl. No.: 17/300,834

(22) Filed: Nov. 22, 2021

(51) Int. Cl.
*B65H 49/32* (2006.01)
*B65H 49/36* (2006.01)

(52) U.S. Cl.
CPC ..... *B65H 49/325* (2013.01); *B65H 49/36* (2013.01)

(58) Field of Classification Search
USPC ..... 242/599.3, 599.4
See application file for complete search history.

(56) References Cited

U.S. PATENT DOCUMENTS 1,693,876 A * 12/1928 Unruh, Jr. ..... B65H 75/08 242/129.51
2,667,310 A * 1/1954 Egee ..... B65H 54/40 242/129.51
2,867,390 A * 1/1959 Anrig ..... B65H 49/32 242/422.8
3,117,740 A * 1/1964 Rose ..... D06B 23/02 242/129.51
4,365,768 A * 12/1982 Woodruff ..... B65H 49/325 242/559.3

(Continued)

FOREIGN PATENT DOCUMENTS

CN 114132794 A * 3/2022
DE 4211064 A1 3/1993 ..... B65G 1/026
EP 0634350 A1 1/1995 ..... B65H 16/06

OTHER PUBLICATIONS

Machine Translation of EP 0 634 350 A1 Jan. 18, 1995. (Year: 1995).

(Continued)

*Primary Examiner* — William A. Rivera
(74) *Attorney, Agent, or Firm* — Michael E. McKee

(57) ABSTRACT

Each of a pair of spool-supporting struts for a spool-holding rack having two pairs of vertical posts between which the struts are mounted utilizes an axle assembly having rotatable end portions for resting upon the struts and a beam having two opposite end portions. The beam includes an upwardly-opening pocket which is adapted to accept a rotatable end portion of the axle assembly directed downwardly therein, and there is associated with each end portion of the beam a platen portion which is positionable outboard of the pair of vertical posts. In addition, an abutment surface is associated with the upwardly-opening pocket for aiding in the locating of an end portion of the axle assembly in vertical registry with the upwardly-opening pocket, and the upwardly-opening pocket includes a pair of spool-centering guide plates along the side opening thereof.

4 Claims, 8 Drawing Sheets

(56) References Cited

U.S. PATENT DOCUMENTS

| | | | | |
|---|---|---|---|---|
| 4,732,345 | A * | 3/1988 | Golden | B65H 75/38 137/355.27 |
| 5,029,766 | A * | 7/1991 | Emming | B65H 49/26 242/129.6 |
| 5,636,808 | A * | 6/1997 | Colin | E04H 4/101 242/395 |
| 6,338,453 | B1 * | 1/2002 | Meyer | B65H 18/028 242/546 |
| 6,345,781 | B1 * | 2/2002 | Bowers | B65H 19/126 242/574.4 |
| 6,533,214 | B1 * | 3/2003 | Guttin | B65H 18/10 242/596.7 |
| 6,685,131 | B1 * | 2/2004 | Zimmer | D06B 3/32 68/180 |
| 9,889,871 | B1 * | 2/2018 | Jordan | B62B 5/0086 |
| 10,501,281 | B1 * | 12/2019 | Newgent | B65H 49/321 |
| 2004/0200922 | A1 * | 10/2004 | Nakamura | B65H 16/06 242/559.2 |
| 2016/0145069 | A1 * | 5/2016 | Jordan | F16M 11/24 242/596.7 |
| 2018/0201469 | A1 | 7/2018 | Martinson | |
| 2019/0185288 | A1 * | 6/2019 | Hawkins | B62B 3/104 |

OTHER PUBLICATIONS

Machine Translation of DE 42 11 064 A1, Mar. 4, 1993. Year: 1993).

* cited by examiner

STRUT FOR A SPOOL-HOLDING RACK AND A SPOOL-SUPPORTING AXLE ASSEMBLY FOR USE THEREWITH

This is a divisional application of application Ser. No. 16/602,024, filed Jul. 22, 2019 and the entire disclosure of which is hereby incorporated herein by reference.

BACKGROUND OF THE INVENTION

This invention relates generally to means and methods for supporting a spool for holding windable material within a spool-holding rack and relates, more particularly, to support structure which is interposed between the frame of a spool-holding rack and a spool.

A spool of the class with which this invention is concerned commonly includes an elongated hollow core about which a windable material, such as wire, cable or rope, can be wound or from which the windable material can be unwound. Such a spool commonly includes a pair of disc-like flanges mounted on opposite sides of the spool and at the opposite ends of the hollow core.

Meanwhile, the class of spool-holding racks with which this invention is concerned includes a rectangular frame having vertical posts at the corners thereof, and each post defines a series of apertures which extend along the length of the posts. In addition, a first elongated strut is mounted at each of its ends to a pair of vertical posts of the rack (by way of the apertures defined along the posts) so as to extend substantially horizontally across the rack, and a second elongated strut is mounted at each of its ends to another pair of vertical posts of the rack (by way of the apertures defined along the posts) so as to extend substantially horizontally across the rack. When mounted within the rack, the first and second struts are disposed in a substantially parallel relationship and are oriented at a common horizontal level. A rod or similar axle-providing item is commonly positioned through the hollow core of a spool desired to be supported within the rack and provides opposite end portions which protrude away from opposite sides of the spool, and these protruding end portions are adapted to rest upon the first and second struts so that the spool is positioned between the first and second struts.

It would be desirable to provide a new and improved strut for such a spool-holding rack and a new and improved axle assembly which is positionable through the hollow core of a spool for use with the strut.

Accordingly, it is an object of the present invention to provide a new and improved strut for a spool-holding rack of the aforedescribed class which improves upon struts of the prior art.

Another object of the present invention is to provide such a strut which can be attached to or detached from such a rack with relative ease.

Still another object of the present invention is to provide such a strut which includes improved means for cooperating with a spool desired to be positioned upon the strut.

Yet another object of the present invention is to provide such a strut which includes at least one upwardly-opening pocket disposed along the length of the strut.

A further object of the present invention is to provide such a strut which facilitates the positioning of a spool upon the strut during an operation involving the loading of a spool within a spool-holding rack.

A still further object of the present invention is to provide such a strut which is uncomplicated in structure, yet strong and effective in operation.

One more object of the present invention is to provide a new and improved axle assembly capable of supporting a spool within a spool-holding rack which includes struts of the present invention.

Yet one more object of the present invention is to provide such an axle assembly which is uncomplicated in structure, yet effective in operation.

SUMMARY OF THE INVENTION

This invention resides in a strut and a spool-holding axle assembly for a spool-holding rack having a pair of vertically-oriented posts between which the strut is mounted and wherein a spool which is capable of being supported by the strut includes a barrel which extends between two opposite sides of the spool and about which a windable material can be wound or from which a windable material can be unwound and a protruding end portion which protrudes from one of the two sides of the spool for resting upon the strut.

In one aspect of the invention, the strut includes an elongated beam having two opposite end portions wherein one end portion of the beam is connectable to one of the pair of vertically-oriented posts of the spool-supporting rack and the other end portion of the beam is connectable to the other of the pair of vertically-oriented posts of the spool-holding rack. In addition, an upwardly-opening pocket is associated with the elongated beam and which is adapted to accept a protruding end portion of a spool directed downwardly therein. Furthermore, there is associated with each end portion of the beam a platen portion which is positionable adjacent a corresponding one of the pair of vertically-oriented posts so that when the strut is arranged within the rack for attachment to the pair of vertically-oriented posts, the platen portions of the two end portions of the beam are arranged outboard of the pair of vertically-oriented posts.

In another aspect of the invention, the elongated beam includes an upper surface along which a spool is moved during an operation involving the positioning of the spool upon the struts, and there is associated with the upwardly-opening pocket an abutment surface which is adapted to abuttingly engage a protruding end portion of the spool when the spool is moved along the upper surface of the beam as aforesaid so that upon engagement of the protruding end portion of the spool with the abutment surface, the protruding end portion is disposed in substantially vertical registry with the upwardly-opening pocket so that the upwardly-opening pocket is in position to accept the protruding end portion of the spool when the spool is substantially lowered therein.

In yet another aspect of the present invention, the axle assembly is positionable through the barrel of the spool and is used with a spool-holding rack having a pair of struts which extend along opposite sides of the rack and wherein each strut includes an upwardly-opening pocket. More particularly, the axle assembly includes an axle member having two opposite ends and a longitudinal axis which extends between the two opposite ends. The axle assembly also includes a pair of bearing assemblies wherein each bearing assembly includes a rod section and a sleeve which is arranged about the rod section and is joined thereto for rotation relative to and about the rod section. In addition, each bearing assembly is cooperable with a corresponding end of the axle member so that by positioning each bearing assembly in cooperating relationship with a corresponding end of the axle member and positioning the sleeve of each bearing assembly within a corresponding upwardly-opening pocket of the pair of struts, the axle member is permitted to rotate relative to the struts about the longitudinal axis of the axle member.

DETAILED DESCRIPTION OF AN ILLUSTRATIVE EMBODIMENT

Figure 1:
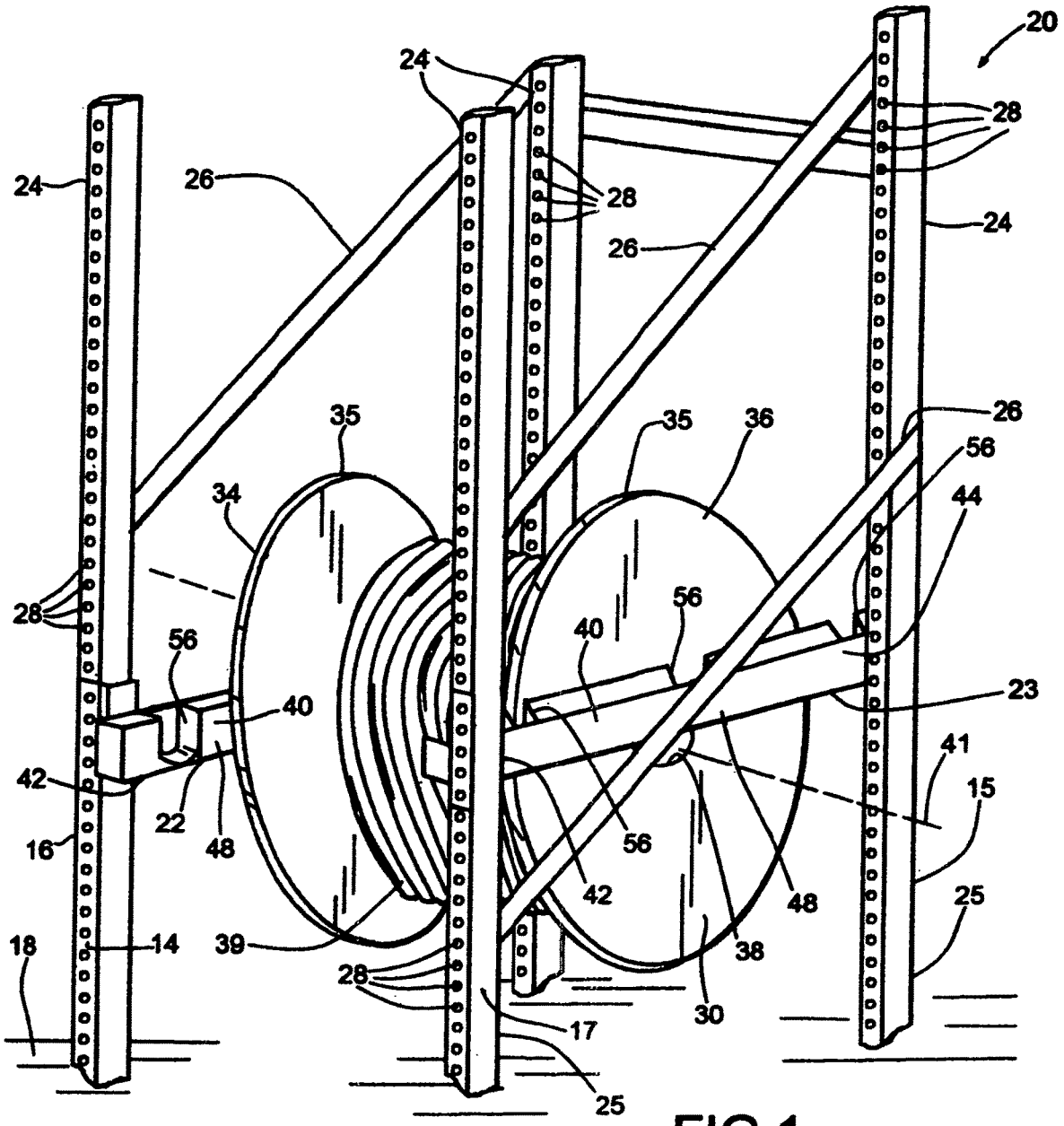
FIG. 1 is a perspective view of a spool-holding rack within which a pair of struts embodying features of the present invention are mounted and a spool of windable material which rests across the struts.

Turning now to the drawings in greater detail and considering first FIG. 1, there is illustrated a spool-holding rack 20 within which an embodiment of a strut 22 or 23 which is capable of being mounted within the rack 20 and within which features of the present invention are embodied. Briefly, the rack 20 is in the shape of a rectangular prism having four vertical posts 24, 25 arranged at the corners of the rack 20, and the vertical posts 24, 45 are joined together with braces 26 which extend therebetween. The rack 20 has a front 14, a back 15, a left side 16 and a right side 17. Each vertical post 24 or 25 defines a series of apertures, or openings 28, which extend therealong (and open forwardly and rearwardly of the rack 20), and as will be apparent herein, these openings 28 are used to join, or mount, the struts 22, 23 to the vertical posts 24.

Within the depicted FIG. 1 rack 20, one pair of vertical posts 24 are disposed on one side 16 of the rack 20, and another pair of vertical posts 25 are disposed on the opposite, or opposing, side 17 of the rack 20. For supporting a spool, indicated 30 in FIG. 1, between the two sides 16, 17 of the rack 20, a first strut 22 is joined to and extends between the vertical posts 24 disposed on one side 16 of the rack 20, and a second strut 23 is joined to and extends between the vertical posts 25 disposed on the opposite side 17 of the rack 20. Together, the struts 22, 23 cooperate to support a spool 30 which is positioned upon so as to extend between the struts 22, 23.

Figure 2:
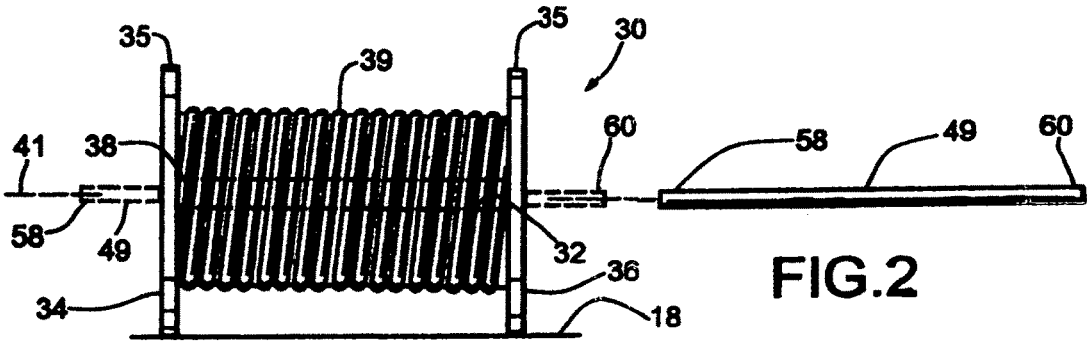
FIG. 2 is a front elevation view of a spool like that of FIG. 1 shown resting upon a floor and provided with an axle which can be directed through the barrel of the spool.
Figure 3:
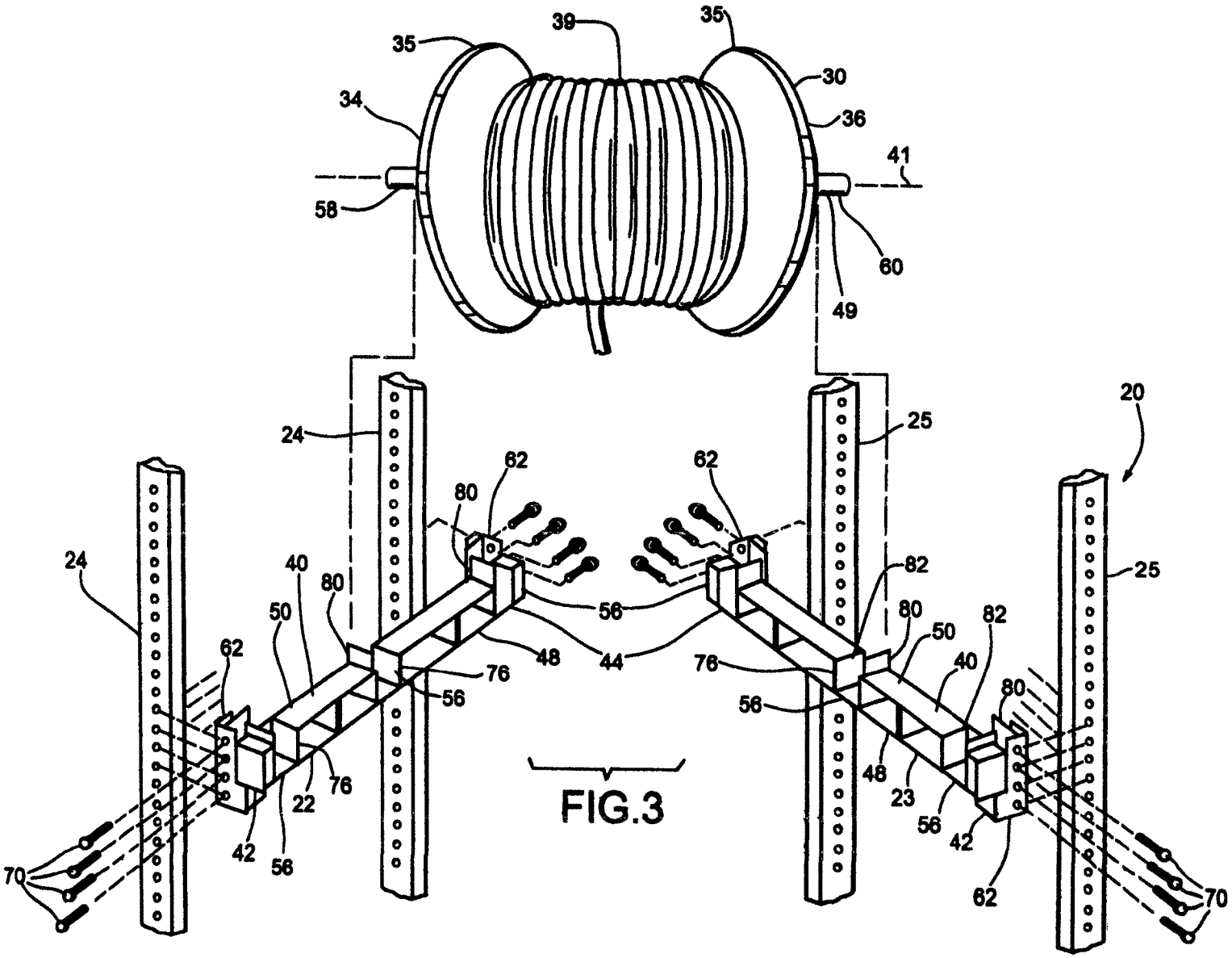
FIG. 3 is a perspective view of a fragment of the rack, struts and spool of FIG. 1 as seen generally from the left in FIG. 1, shown exploded.
Figure 4:
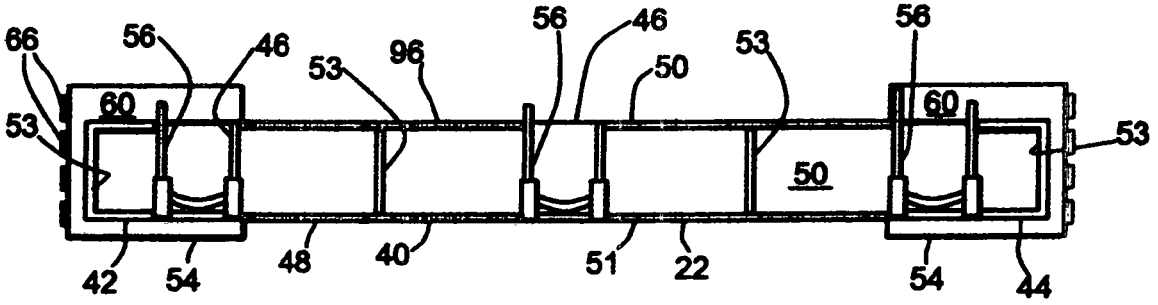
FIG. 4 is a side elevation view of the leftwardmost strut of FIG. 3 as seen generally from the right in FIG. 3.
Figure 5:
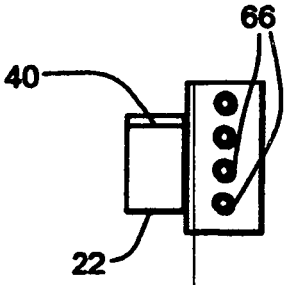
FIG. 5 is an end elevation view of the strut of FIG. 4 as seen from the right in FIG. 4.

With reference to FIGS. 1 and 2, the spool 30 is of a class of spools which can be supported upon the spool-holding rack 20. Briefly, the spool 30 includes a centrally-disposed, hollow elongated barrel 32 about which a length of coiled material 39, such as electrical wire, steel cable or rope, is wound and includes a pair of disc-like flanges 34, 36 attached to the opposite ends of the barrel 32 on the opposite sides of the spool 30. Each flange 34 or 36 is circular in form and defines a cylindrical rim 35 along its peripheral edge. Furthermore, there is commonly provided a bore 38 which extends through the center of both flanges 34, 36 and the elongated barrel 32. In addition, the bore 38 defines an elongated axis 41 about which the spool 30 is permitted to be rotated as the spool 30 is supported by the rack 20 and in an elevated condition above the underlying floor 18 to facilitate the unwinding of the material 39 about the barrel 32 of the spool 30 or to facilitate the winding of the material 39 about the barrel 32 of the spool 30.

As will be apparent herein and to enable the spool 30 to be supported between the struts 22 and 23, an axle 49 is directed through the bore 38 of the spool 30 so as to provide end portions, described herein, which protrude axially from the opposite sides of the spool 38, and it is these protruding end portions which are positioned upon the struts 22, 23. In particular and with reference to FIG. 2 wherein the axle 49 is shown to be movable between a solid-line condition disposed to one side of the spool 30 and a phantom-line condition disposed through the spool barrel 32 at which end portions, indicated 58 and 60, of the axle 49 protrude away from the opposite sides of the spool 30 and are disposed outboard of the spool flanges 34, 36.

With reference to FIGS. 3-8, each strut 22 or 23 is elongated in shape having two opposite end portions 42, 44 and includes a main steel beam 40 comprised of a channel-shaped member 48 having a substantially U-shaped cross section (best shown in FIG. 8) having two (e.g. upper and lower) legs 50 and 51 and a base 52 which extends between the legs 50, 51. When secured in place within the rack 20, the base 52 of the beam member 48 is substantially oriented in a vertical plane while the upper and lower legs 50 and 51 are oriented in substantially horizontal and parallel planes. In addition, the member 48 extends along the entire length of the strut 22 or 23, and its (upper) leg 50 is appropriately notched with a cutout 46 (FIG. 8) at a plurality of (e.g. three) locations therealong to accommodate the presence of a plurality of (e.g. three) upwardly-opening pockets 56 (best shown in FIG. 8) for accepting (and cradling therein) a corresponding one of the end portions 58 or 60 of the axle 49 (FIG. 2) which extends through the spool barrel 32. A plurality of vertically-oriented members 53 (best shown in FIG. 4) extend and are attached between the legs 50, 51 of the channel-shaped member 48 to enhance the strength of the strut 22 or 23.

Figure 6:
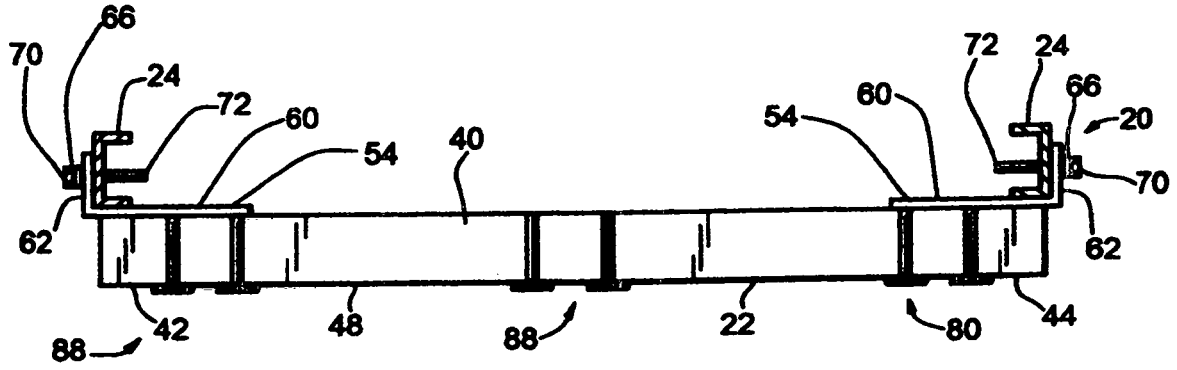
FIG. 6 is a top plan view of the strut of FIG. 4 as seen from above in FIG. 4 as depicting in cross section the vertical posts of the rack of FIG. 1 upon which the strut is mounted.
Figure 7:
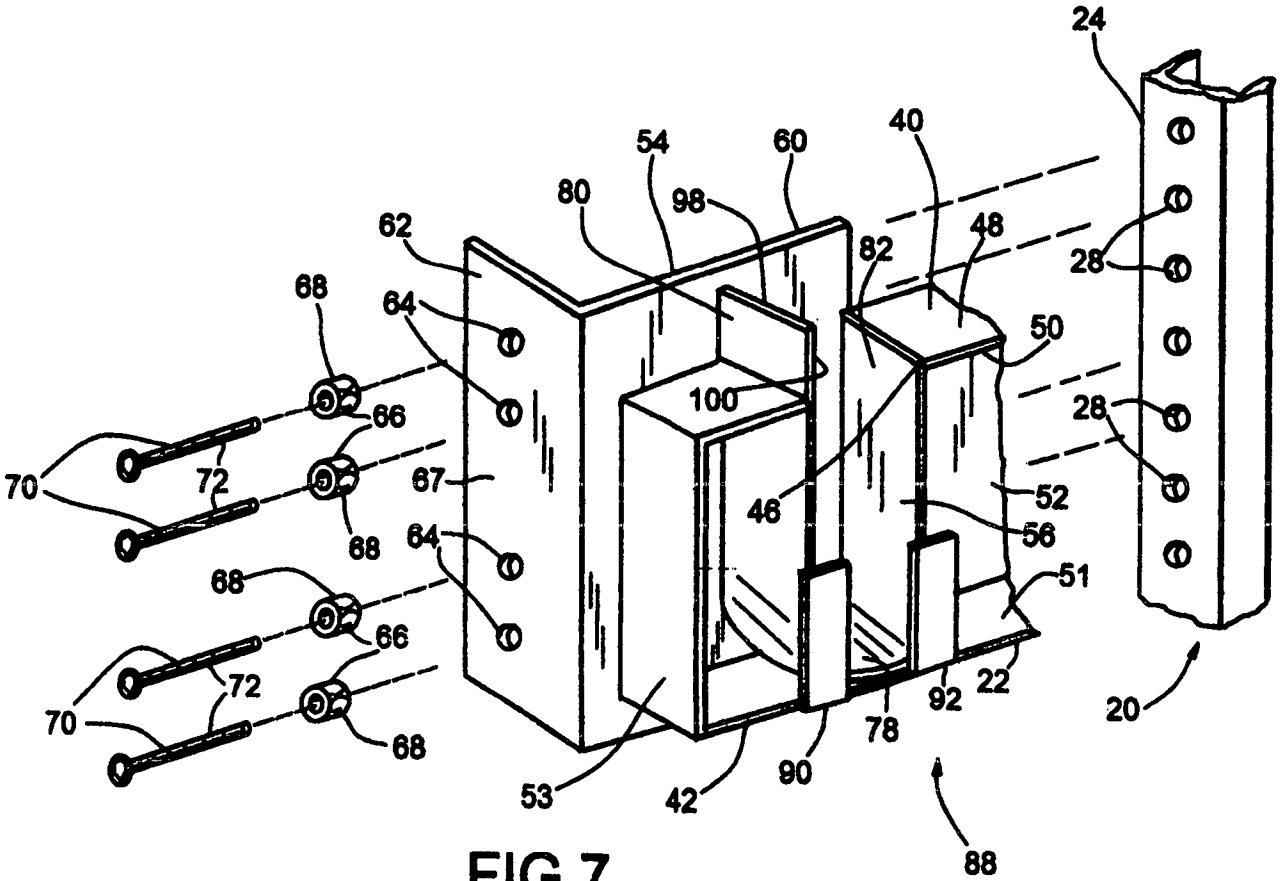
FIG. 7 is a perspective view of a fragment of the FIG. 4 strut but drawn to a slightly larger scale and shown exploded.

As best shown in FIGS. 4-7, there is associated with each end portion 42 or 44 of a strut 22 or 23 a mounting bracket 54 which facilitates the attachment of the elongated beam 40 between a corresponding pair of vertical posts 24 or In this connection, each bracket 54 includes a first platen portion, or leg 60, which is fixedly attached, as with welds, against the base 52 of the member 48 and a second platen portion, or leg 62, which is joined to the leg 60 at a substantially right angle with respect thereto to provide the bracket 54 with an L-shaped cross section. The leg 62 of each bracket 54 includes a plurality of, or series of, through-openings 64 (FIG. 7) which extend along the length of the leg 62, and internally-threaded nuts 66 are welded to the outer surface, indicated 67, of the leg 62 so that the internally-threaded opening, indicated 68, of each nut 66 is aligned with a corresponding through-opening 64 provided along the platen leg 60. As best shown in FIG. 7, the nuts 66 are arranged along the side of the platen leg 62 which faces axially away from the corresponding end portion 42 or 44 to which the bracket 54 is joined.

Since the through-openings 64 of the platen leg 62 are intended to be positioned in an aligned relationship with corresponding openings 28 provided along the lengths of the posts 24 or 25 when the struts 22, 23 are connected to the posts 24, 25, it is preferred that the distance as measured between adjacent through-openings 64 in the series of through-openings 64 corresponds with, or is substantially equal to, the distance as measured between adjacent openings 28 provided along the lengths of the posts 24 or 25. For attaching the elongated beam 40 to the vertical posts 24 or 25 by way of the brackets 54, the elongated beam 40 is arranged across a corresponding pair of vertical posts 24 or 25 (as best shown in FIG. 6) so that the platen legs 62 of the brackets 48 are positioned outboard of the pair of posts 24 or 25 and the through-openings 64 of the bracket legs 62 are aligned with corresponding through-openings 28 arranged along the post 24 or 25. At that point, bolts 70 (FIG. 7) having threaded shanks 72 are threaded shank-end first through the openings 68 of the nuts 66 so that the major portions of the bolt shanks 72 extend through the bracket legs 62 and posts 24 or 25 and are positioned inboard of the pair of posts 24 or 25 (as best shown in FIG. 6).

It follows from the foregoing that with the shanks 72 of the bolts 70 extending through both the through-openings 64 of the bracket legs 62 and the through-openings 28 of the posts 24 or 25, the weight of the elongated beam 40 (and any spool 30 supported thereby) is transferred to the posts 24 or by way of the shanks 72 of the bolts 70. It also follows that the internally-threaded openings 68 of the nuts 66 provide the aligned openings 68 and 64 with an internally-threaded section through which the shanks 72 of the bolts 70 can be threaded.

Furthermore, the disposition of the legs 62 of the bracket members 54 of the strut 22 or 23 outboard of the pair of vertical posts 24 or 25 to which the strut 22 or 23 is secured prevents any lengthwise shifting of the elongated beam of the strut 22 or 23 relative to the pair of posts 24 or to which the elongated beam 40 is secured and obviates any need to thread additional nuts (not shown) upon the bolt shanks 72 disposed inboard of the pair of posts 24 or 25.

Figure 8:
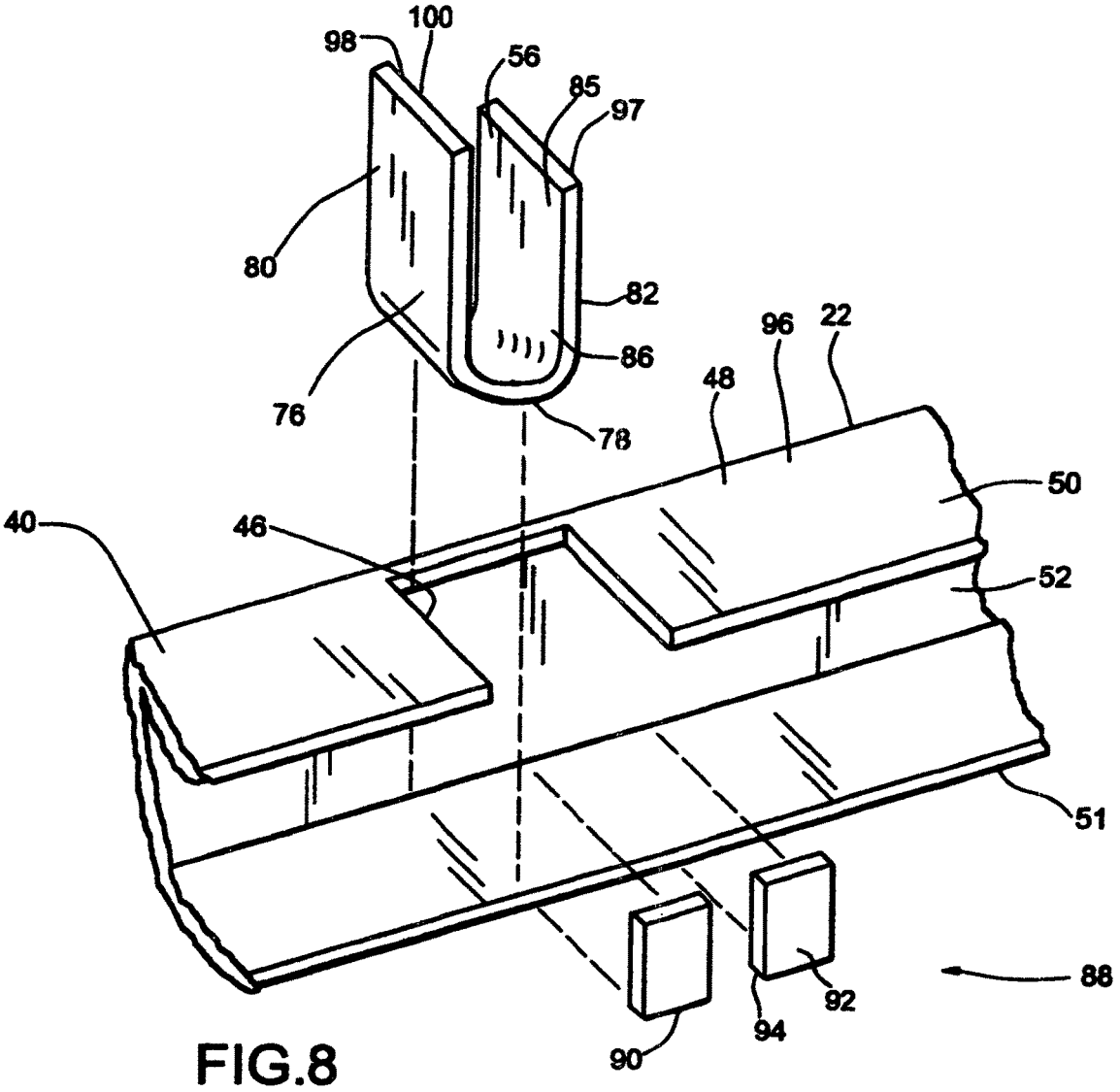
FIG. 8 is a perspective view of an alternative fragment of the FIG. 4 strut, shown exploded.

With reference again to FIGS. 3-8, each upwardly-opening pocket 56 includes a U-shaped bracket 76 having two opposing legs 80, 82 which are joined by an arcuate portion 78 extending therebetween. One leg 80 of the bracket 76 is longer than the other leg 82 for a reason which will be apparent herein. As mentioned earlier, the upper leg 50 of the channel 48 of the beam 40 is provided with a plurality of (i.e. three) notches formed by cutouts 46 defined along the upper leg 50 of the channel-shaped member 48, and each bracket 76 is arranged within a corresponding cutout 46 so that the bottom of the U-shape of the bracket 76 rests upon (the upper surface of) the lower leg 51 of the elongated beam 40. At that point, the bracket 76 is secured, as with welds, to the base 52 and legs 50, 51 of the channel-shaped member 48 so that the U of the U-shape of the bracket 76 opens upwardly so as to provide an upwardly-directed opening, indicated 85 (FIG. 8). Meanwhile, the U of the bracket 76 also opens away from one side of the beam 40 and toward the inside of the rack 20 (FIG. 1) through a side opening, indicated 86 (FIG. 6). As will apparent herein, the side opening 86 accommodates the presence of an axle 49 whose end portion 58 or 60 rests within the upwardly-opening pocket 56 when a spool 30 is supported within the rack 20 and by way of the struts 22, 23.

It is also a feature of each strut 22 or 23 that it includes means, generally indicated 88 in FIGS. 6-9, for guiding the end portion 58 or 60 of an axle 49 downwardly into the bottom of the U-shaped bracket 76 of the upwardly-opening pocket 56 and maintaining the axle end portion 58 or 60 substantially centrally of the side opening 86 therein. Within each depicted strut 22 or 23, the guide means 88 includes a pair of rectangular-shaped plate members 90, 92 which are positioned along the edges of the U-shaped bracket 76 disposed on the side thereof opposite the base 52 of the channel member 48 and welded thereto so that the side opening 86 is substantially reduced in size adjacent the bottom of the bracket 76 when compared to the size of the side opening 86 measured across the top of the bracket 76. In addition, the plate members 90, 92 provide a spacing 94 therebetween which closely accepts an end portion 58 or 60 of an axle 49 positioned within the upwardly-opening pocket 56. This spacing 94 helps to maintain the accepted end portion 58 or 60 of the axle 49 centrally of the side opening 86 (i.e. centrally with respect to the bracket legs 80, 82) and is particularly advantageous in this regard if the axle 49 is permitted to rotate during a material winding or unwinding operation while the spool 30 rests within the upwardly-opening pockets 56 of the struts 22, 23.

As mentioned earlier, one leg 80 of the U-shaped bracket 76 of each upwardly-opening pocket 56 is longer than the other leg 82 of the U-shaped bracket 76. In this connection and with reference to FIGS. 8 and 9, the shorter leg 82 has an upper edge 97 which is arranged at about the same horizontal level as the upper surface, indicated 96, of the upper leg 51 of the elongated beam 40, and the longer leg has an upper edge 98 which is extends upwardly from the upper surface 96 by an appreciable amount (i.e. at least about 2.0 inches). This portion of the longer leg 80 which extends upwardly from the horizontal level of the upper surface 96 provides an abutment surface 100 which facilitates the positioning of the spool 30 and, more particularly, the axle 49 which extends through the spool barrel 32 in substantially vertical registry with the upwardly-directed opening 85 of the upwardly-opening pocket 56.

More specifically and when it is desired to position a spool 30 with the rack 20 (either by way of a forklift truck or portable jacks upon which the spool 30 is supported), the spool 30 (and any axle 49 positioned therethrough) is moved axially along the elongated beam 40 and in an elevated condition above the upper surface 96 of the beam 40. By advancing the spool 30 (and any axle 49 positioned therethrough) axially along the upper surface 96 (and in the direction therealong indicated by the FIG. 9 arrow 102) and in a relatively close proximity to the upper surface 96, the axle 49 moves into engagement with the abutment surface 100 whereupon the continued advancement of the axle 49 along the upper surface 96 is halted. Upon engagement with the abutment surface 100, the axle 49 is positioned in substantially vertical registry with the upwardly-directed opening 85 of the upwardly-opening pocket 56 within which the axle 49 is desired to be positioned. Since it is often difficult to visually determine when, during an operation involving the positioning of a spool 30 within the rack 20, a protruding end portion 58 or 60 of an axle 49 is disposed in vertical registry with an upwardly-opening pocket 56, this locating stop feature provided by the abutment surface 100 is advantageous in this respect. It follows that by subsequently lowering the axle 49 downwardly after the axle 49 has been moved into engagement with the abutment surface 100 will automatically direct the axle 49 into its desired position within the upwardly-opening pocket 56.

Figure 9:
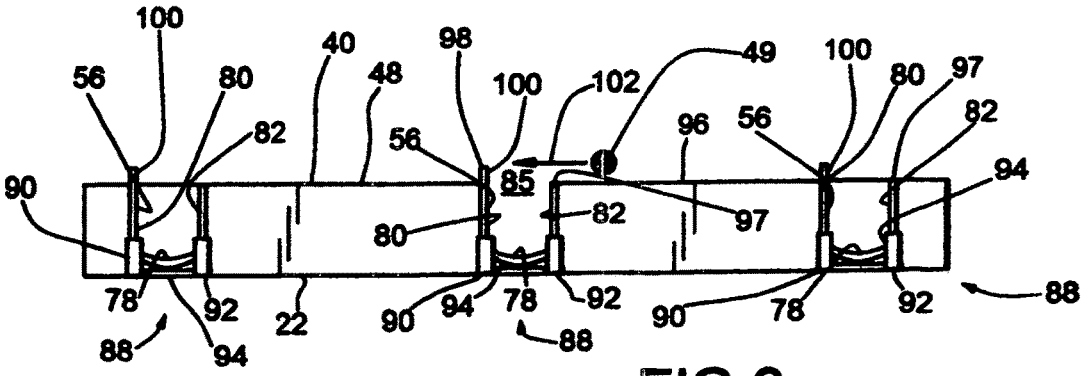
FIG. 9 is an elevation view of the strut of FIG. 4 similar to that of FIG. 4 illustrating schematically the approach of an axle toward a upwardly-opening pocket of the FIG. 4 strut during an operation involving the positioning, or loading, of a spool into place upon the strut.

It will be understood that in accordance with the aforediscussed feature, the axle 49 must be moved toward the left as viewed in FIG. 9 (and along the axial direction indicated by the arrow 102) in order for the abutment surface 100 to be exposed to the axle 49 moving theretoward. Accordingly, the construction of the other strut 23 is preferably a mirror image to that of the strut 22 in order that the abutment surface 100 provided by the longer leg 80 of the upwardly-opening pocket 56 be positioned upon the appropriate side of the upwardly-opening pocket 56. In other words, in order for the longer leg 80 of the upwardly-opening pockets 56 of both struts 22, 23 to be exposed to an axle 49 advanced theretoward in the same axial direction along the upper surfaces of the elongated beams 40 of both struts 22, 23, the abutment surfaces 100 of the struts 22, 23 must face the same axial direction along the struts 22, 23 (i.e. either forwardly or rearwardly relative to the rack 20).

Figure 10:
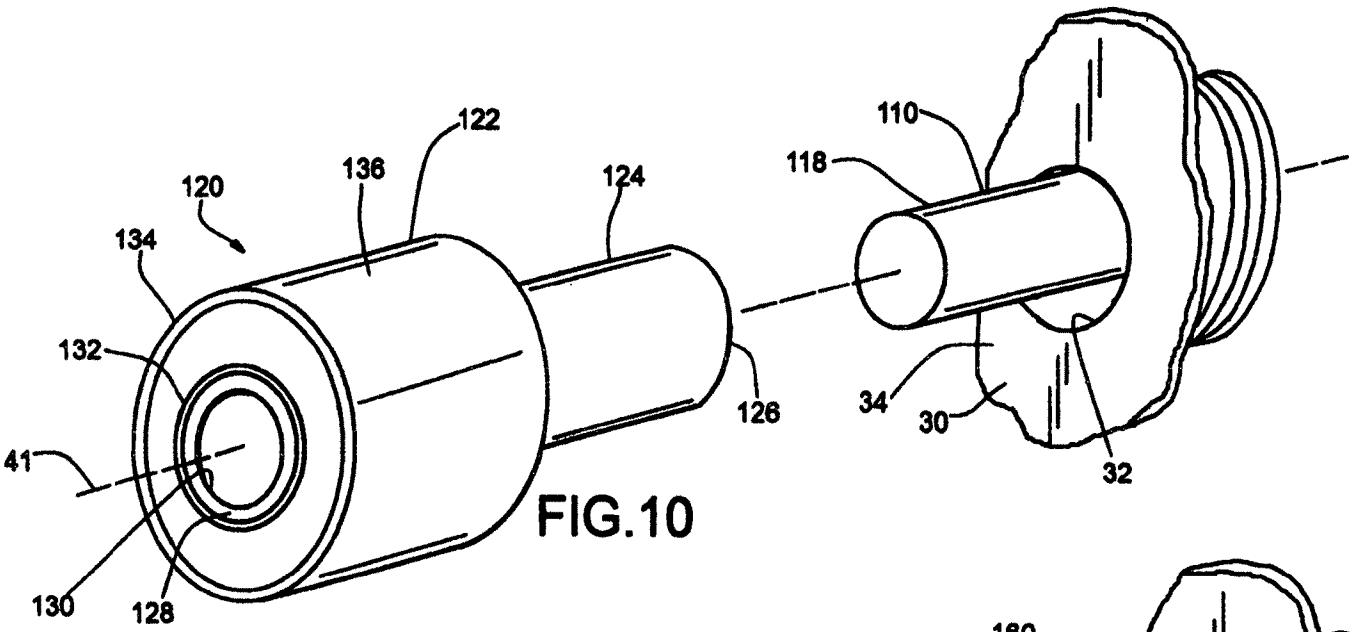
FIG. 10 is a perspective view of one embodiment of a bearing assembly positionable upon the end of one class of spool-supporting axle.
Figure 11:
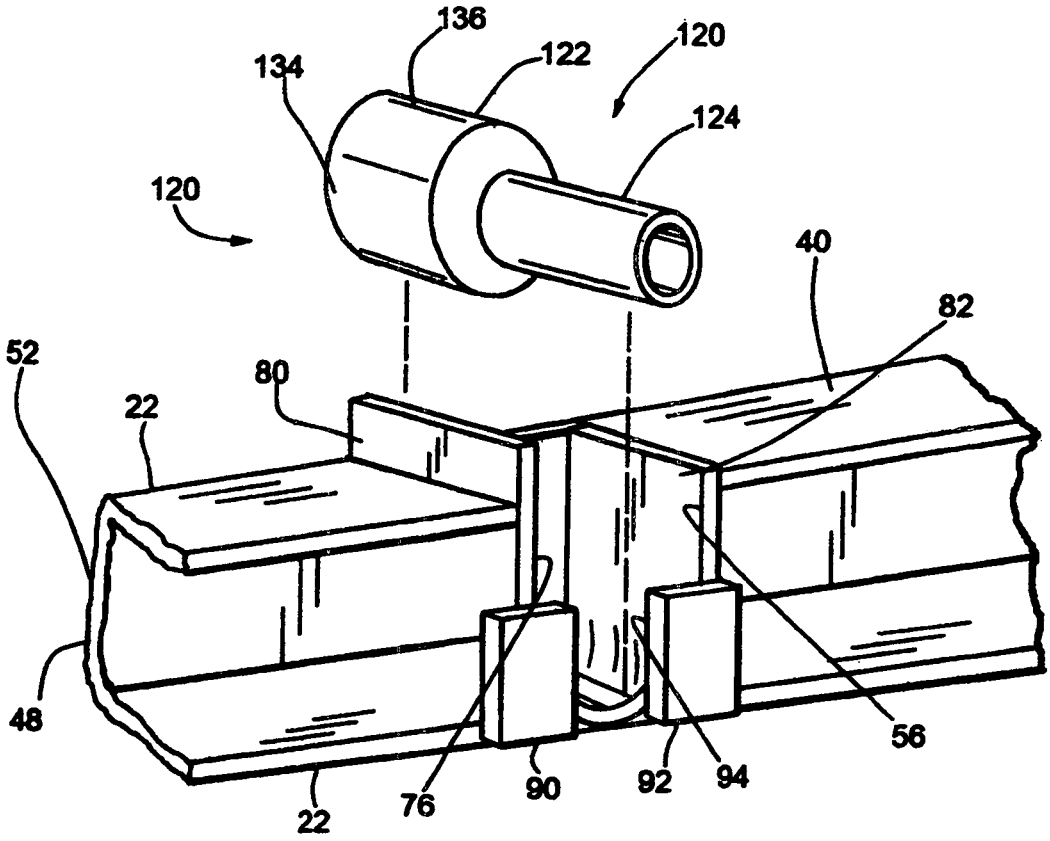
FIG. 11 is a perspective view of the bearing assembly of FIG. 10 prior to being positioned within one of the upwardly-opening pockets of the strut of FIG. 4.
Figure 12:
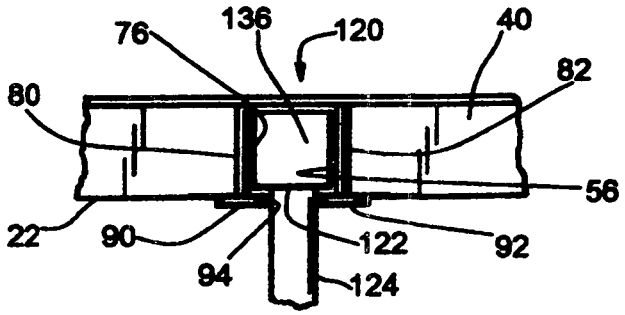
FIG. 12 is a top plan view of the FIG. 4 strut and FIG. 10 bearing assembly, shown assembled and as seen from above in FIG. 11.

With reference to FIGS. 10-13, there are illustrated embodiments of bearing assemblies which are well-suited for interacting with an axle which extends through the barrel 32 of a spool 30 for supporting the spool 30 across the struts 22, 23 in a manner which permits the spool 30 to be rotated about its longitudinal axis 41 within the upwardly-opening pockets 56. For example, there is depicted in FIGS. 10-12 a bearing assembly, generally indicated 120, which is adapted to be positioned about a solid axle, indicated 110, directed through the barrel 32 of a spool 30 and includes a bearing pack 122 which, in turn, is positionable within the upwardly-opening pocket 56 of a strut 22 or 23. In addition to the bearing head 122, the assembly 120 includes a hollow tube 124 having two opposite ends 126, 128 and which is centrally disposed within the bearing pack 122. The tube 124 includes a hollow interior, generally indicated 130, which is adapted to be slidably positioned end 126-first over a protruding end portion, indicated 118, in FIG. 10, of the axle 149.

Meanwhile, the bearing pack 122 includes a inner race, or sleeve 132, which is tightly secured about the tube 124 adjacent the end 128 thereof and includes an outer race, or sleeve 134 (having an outer surface 136), which can be rotated relative to the inner sleeve 132 by way of internal bearings arranged between the inner and outer sleeves 132, 134. By directing the hollow tubes 124 of a pair of bearing assemblies 120 end 126-end first about the opposite end portions of the axle 149, and then manipulating the bearing packs 122 of the pair of bearing assemblies 120 downwardly within two upwardly-opening pockets 56 of the struts 22, 23 (which pockets 56, 56 are arranged on opposite sides of the FIG. 1 rack 20), the spool 30 is free to rotate relative to the struts 22, 23 and about the spool axis 41 as the tube 124 is permitted to rotate within the outer sleeve 134 of the bearing pack 122.

Figure 13:
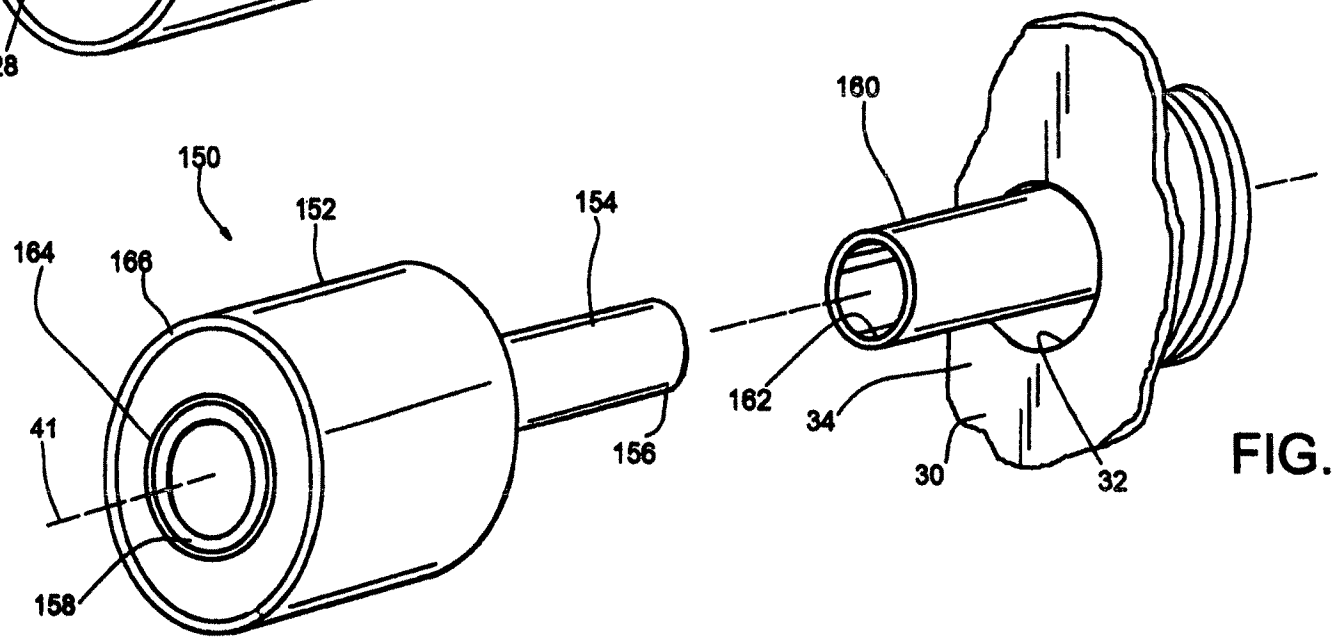
FIG. 13 is a perspective view of another embodiment of a bearing assembly which is positionable upon the end of another class of spool-supporting axle.

As best shown in FIGS. 12 and 13, the bearing pack 120 is sized to be closely accepted by an upwardly-opening pocket 56 of a strut 22 or 23 when manipulated downwardly therein. Accordingly, the bearing pack 122 has a length which is slightly less than the depth of the pocket 56 (wherein the pocket depth corresponds to the width of either leg 80 or 82 of the bracket 76), and the bearing pack 122 has an outer diameter (equal to the diameter of the outer surface 136) which is slightly less than the width of the pocket 56 (wherein the pocket width corresponds with the spaced-apart distance between the bracket legs 80, 82) so that when positioned within the pocket 56, the bearing pack 122 is captured between the legs 80, 82 of the bracket 76 and between the base 52 of the channel-shaped member 48 and the plate members 90, 92 while the tube 124 extends through the spacing 94 provided between the plate members 90, 92. It follows that the diameter of the tube 124 is slightly less than the width of the spacing 94 defined between the plate members 90, 92.

By comparison, there is illustrated in FIG. 13 a bearing assembly 150 having a bearing pack 152 and a solid tube, or rod section, 154 having two opposite ends 156, 158 and which is adapted to be accepted by an end portion of an axle, indicated 160, having a hollow interior 162. The bearing pack 152 includes an inner sleeve 164 which is tightly secured about the tube 154 and includes an outer sleeve 166 which is permitted to be rotated relative to (and about) the inner sleeve 164 and the tube 154 positioned therein. It follows that by directing the tubes 154 of a pair of bearing assemblies 150 end 156-first into the hollow interiors 162 of the (opposite) end portions of the axle 160 and then manipulating the bearing packs 152 of the bearing assemblies 150 downwardly within two upwardly-opening pockets 56 of the struts 22, 23 (which pockets 56 are arranged on opposite sides of the FIG. 1 rack 20), the spool 30 is free to rotate relative to the struts 22, 23 and about the spool axis 41 as the tube 154 is permitted to rotate within the outer sleeve 166 of the bearing pack 152.

Figure 14:
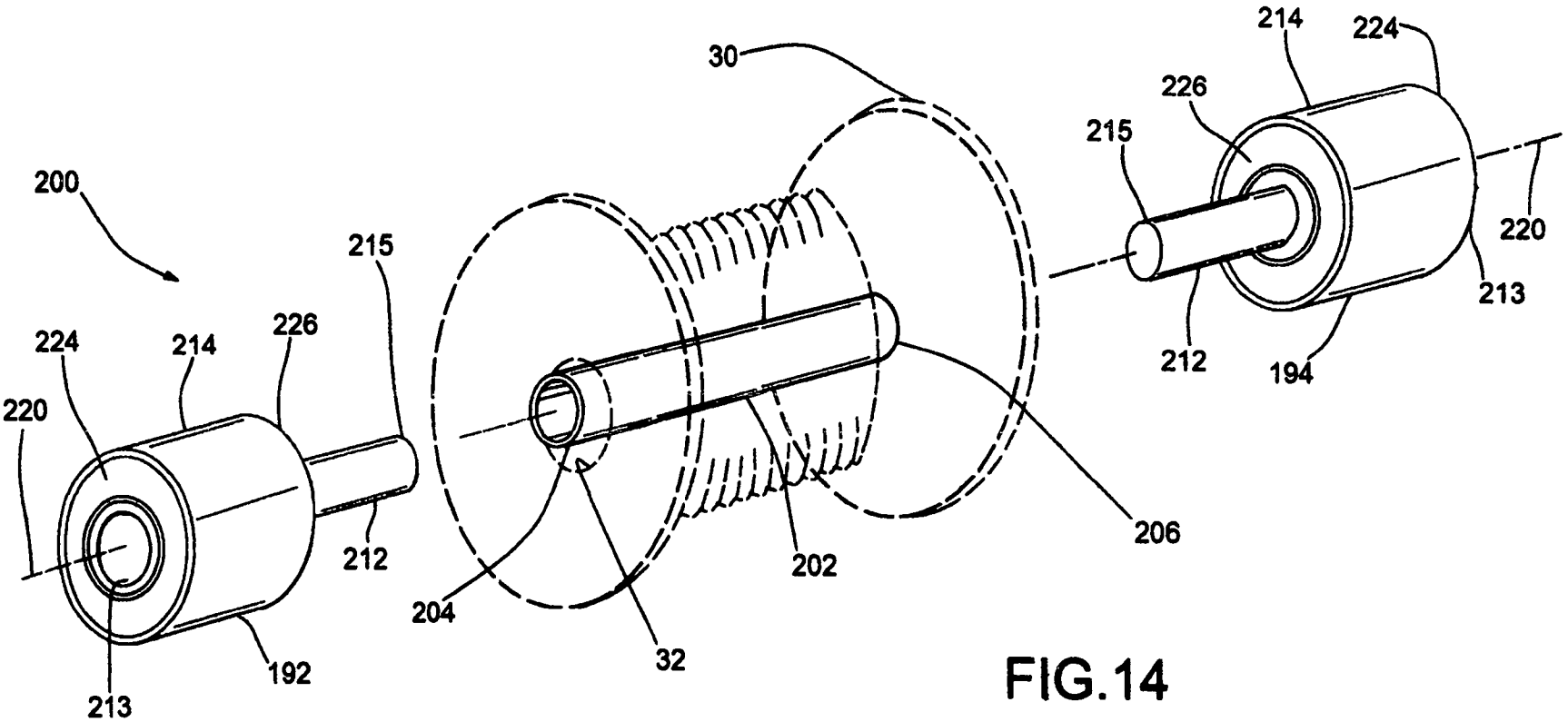
FIG. 14 is a perspective view of a spool-supporting axle assembly within which the bearing assembly of FIG. 13 is incorporated and a spool capable of being held with the axle assembly within the spool-holding rack and struts depicted in FIGS. 1 and 3-9.

With reference to FIG. 14, there is illustrated an embodiment, generally indicated 200, of an axle assembly which incorporates two bearing assemblies, indicated 192, 194 which are each structurally comparable to the aforedescribed bearing assembly 150 of FIG. 13. To this end, the axle assembly 200 includes a hollow tubular axle member 202 constructed, for example, of steel, and which is open at each of its opposite ends 204, 206, and the bearing assemblies 192, 194 are adapted to cooperatively interfit within the open ends 204, 206 of the axle member 202. Moreover, each bearing assembly 192 or 194 includes a relatively short rod section 212 having two opposite ends 213 and 215, an outer sleeve 214 of larger diameter than that of the rod section 212, and a pair of pair of (tapered) roller bearings 224, 226 which are arranged in a side-by-side relationship and which are operatively positioned between the outer surface of the rod section 212 and the inner surface of the sleeve 214. The roller bearings 224, 226 are secured in place between the rod section 212 and the sleeve 214 with conventional means, such as with snap rings, for preventing the inner and outer races of the roller bearings 224, 226 from shifting relative to and along the length of the rod section 212 and the sleeve 214.

The roller bearings 224, 226 are disposed adjacent the end 213 of the rod section 212, and the diameter of the rod section 212 is sized to be closely accepted by a corresponding one of the open ends 204, 206 of the axle member 202 when the end 215 of the rod section 212 is inserted axially into the open end 204 or 206. It follows that the roller bearings 224, 226 permit each of the sleeve 214 and the rod section 212 to be rotated relative to one another about the longitudinal axis, indicated 220, of the rod section.

To assemble the axle assembly 200, the end 215 of each rod section 212 of the bearing assemblies 192, 194 is slidably inserted axially into a corresponding open end 204 or 206 of the axle member 202 so that the sleeves 214 of the bearing assemblies 192, 194 are disposed outboard of the ends 204, 206 of the axle member 202. It follows that when the axle assembly 200 is fully assembled and the sleeves 214 are held in a stationary condition, the axle member 202 is free to rotate about its longitudinal axis relative to the sleeves 214. Furthermore and if it is desired to suspend a spool 30 (shown in phantom in FIG. 14) having a hollow barrel 32 from the FIG. 1 rack 20 by way of the axle assembly 200, the axle member 202 can be first inserted through the hollow barrel 32 of the spool 30 so that the open ends 204, 206 are accessible at each end of the spool 30, and the bearing assemblies 192, 194 can be positioned within the open ends 204, 206 of the spool. At that point, the spool 30 is lifted and the sleeves 214 of the bearing assemblies 192, 194 are manipulated downwardly into the U-shaped pockets 56 of the struts 22, 23 disposed on opposite sides of the rack 20. With the sleeves 214 thereby captured within the U-shaped pockets 56, the spool 30 is free to rotate (with the axle member 202) relative to the (stationary) sleeves 214 of the bearing assemblies 192, 194.

It follows from the foregoing that a pair of struts 22, 23 have been described wherein each strut 22 or 23 includes an elongated beam 40 having two opposite end portions 42, 44 wherein one end portion 42 of the beam 40 is connectable to one of the pair of vertically-oriented posts 24 of a spool-supporting rack 20 and the other end portion 44 of the beam 40 is connectable to the other of the pair of vertically-oriented posts 25 of the spool-holding rack 20. An upwardly-opening pocket 56 is associated with the elongated beam 40 and is adapted to accept a protruding end portion 58 or 60 of a spool 30 directed downwardly therein, and there is associated with each end portion 42 or 44 of the beam 40 a platen (leg) portion 62 which is positionable adjacent a corresponding one of the pair of vertically-oriented posts 24 or 25 so that when the strut 22 or 23 is arranged within the rack 20 for attachment to the pair of vertically-oriented posts 24 or 25, the platen (leg) portions 62, 62 of the two end portions 42 or 44 of the beam 40 are arranged outboard of the pair of vertically-oriented posts 24 or 25.

Furthermore, the elongated beam 40 defines an upper surface 96 which is disposed at one horizontal level when the strut 22 or 23 is mounted within the spool-holding rack 20, and there is associated with each upwardly-opening pocket 56 an abutment surface 100 which extends above the one horizontal level of the upper surface 96 of the elongated beam 40 for providing a locating stop against which the protruding end portion 58 or 60 of the spool 30 can be moved into engagement when the protruding end portion 58 or 60 is moved axially of the beam 40 and along the upper surface 96 thereof during an operation involving the positioning of the spool 30 within an upwardly-opening pocket 56 of the strut 22 or 23.

It will be understood that numerous modifications and substitutions can be had to the aforedescribed strut embodiments 22 or 23 without departing from the spirit of the invention. Accordingly, the aforedescribed embodiments 22 and 23 are intended for the purpose of illustration and not as limitation.

The invention claimed is:

1. In combination:

a spool-supporting axle assembly and a spool-holding rack across which the spool-supporting axle assembly is capable of being supported, the spool-holding rack including a pair of struts which extend along opposite sides of the rack and wherein each strut includes an upwardly-opening pocket having a base and an opening provided in one side thereof which is bordered by a pair of spaced-apart plates, and wherein the axle assembly includes:

an axle member having two opposite ends and a longitudinal axis which extends between the two opposite ends; and a pair of bearing assemblies wherein each bearing assembly includes a rod section and a sleeve which is arranged about the rod section to provide a head of enlarged size for the bearing assembly and which is joined to the rod section for rotation relative to and about the rod section, and each bearing assembly is cooperable with a corresponding end of the axle member so that by positioning each bearing assembly in cooperating relationship with a corresponding end of the axle member and then positioning the head of each bearing assembly within a corresponding upwardly-opening pocket of the pair of struts so that the head is captured between the base of the upwardly-opening pocket and the spaced-apart plates, the axle member is permitted to rotate relative to the struts about the longitudinal axis of the axle member while the head is prevented from passing out of the opening provided in one side of the upwardly-opening pocket by the pair of plates.

2. The combination as defined in claim 1 wherein the rod section of each bearing assembly has a longitudinal axis and each bearing assembly includes a bearing which is interposed between the rod section and the sleeve to permit the rod section and the sleeve to be rotated relative to one another about the longitudinal axis of the rod section.

3. The combination as defined in claim 2 wherein the axle member is open at each of its two opposite ends, and each rod section includes one end portion which is positionable within a corresponding end of the axle member as the one end portion of the rod is directed axially into the corresponding end of the axle member.

4. The combination as defined in claim 1 wherein the pair of struts of the spool-holding rack are arranged at a fixed distance apart so that when the head of each of the two bearing assemblies is positioned within a corresponding one of the upwardly-opening pockets of the struts and the axle member extends between the bearing assemblies, the rod sections are retained within the open ends of the axle member by the spacing of fixed distance between the pair of struts.

* * * * *